US005170911A

United States Patent [19]

Della Riva

[11] Patent Number: 5,170,911

[45] Date of Patent: Dec. 15, 1992

[54] PACKAGING FOR LIQUID OR PULVERULENT PRODUCTS

[75] Inventor: Carlo Della Riva, Brussels, Belgium

[73] Assignee: S.A. Incoplas N.V., Brussels, Belgium

[21] Appl. No.: 659,024

[22] Filed: Feb. 21, 1991

Related U.S. Application Data

[63] Continuation-in-part of Ser. No. 645,265, Jan. 24, 1991.

[30] Foreign Application Priority Data

Feb. 23, 1990 [BE] Belgium ..... 9000204

[51] Int. Cl.[5] ..... B65D 35/56

[52] U.S. Cl. ..... 222/105; 222/183

[58] Field of Search ..... 220/462; 222/105, 107, 222/183, 215, 522, 525, 539, 545

[56] References Cited

U.S. PATENT DOCUMENTS

| | | | |
|---|---|---|---|
| 2,799,427 | 7/1957 | Shekter | 220/20 |
| 3,178,060 | 4/1965 | Bossack | 222/105 |
| 3,226,002 | 12/1965 | Walker | 222/183 |
| 3,252,634 | 5/1966 | Scholle | 222/105 |
| 3,253,764 | 5/1966 | Goetschius et al. | 229/17 |
| 3,977,569 | 8/1976 | Scholle | 222/143 |
| 4,174,051 | 11/1979 | Edwards et al. | 222/183 |

FOREIGN PATENT DOCUMENTS

| | | | |
|---|---|---|---|
| 0264606 | 4/1988 | European Pat. Off. . | |
| 2157769 | 5/1973 | Fed. Rep. of Germany | 222/215 |
| 8904656 | 8/1989 | Fed. Rep. of Germany . | |
| 1194634 | 11/1959 | France . | |
| 2395913 | 1/1979 | France . | |
| 6812152 | 3/1970 | Netherlands . | |
| 0244973 | 10/1969 | U.S.S.R. . | |
| 2088837 | 6/1982 | United Kingdom | 222/105 |

*Primary Examiner*—H. Grant Skaggs
*Attorney, Agent, or Firm*—Leonard Bloom

[57] ABSTRACT

The packaging is an assembly composed of a substantially rigid outer shell and a inner shell in plastic material contained in this outer shell. The relative dimensions of the outer shell and of the inner shell are such that inner shell can be placed either in a first retracted position in which its base rests on the base of the outer shell and its spout is retracted in the outer shell or in a second extended position in which the inner shell is suspended in the outer shell and its spout goes beyond an opening provided in the cover of the outer shell. The inner shell can be displaced between these two positions according to requirements.

17 Claims, 1 Drawing Sheet

PACKAGING FOR LIQUID OR PULVERULENT PRODUCTS

CROSS-REFERENCE TO RELATED APPLICATION

The present application is a continuation-in-part of U.S. application Ser. No. 645,265 filed Jan. 24, 1991 entitled "Packaging for liquid or pulverulent products", the contents of which are hereby incorporated herein.

FIELD OF THE INVENTION

The present invention concerns a packaging for liquid or pulverulent products particularly suitable for food products and chemicals.

BACKGROUND OF THE INVENTION

The packaging and transportation of products which can flow (in particular liquid products) has always been an awkward problem.

Although the transportation of pulverulent products can be made by other means, the invention provides an advantageous alternative.

Metal and glass containers are used much less than in the past: they are generally heavy, they permit few variations in form, and they are relatively expensive. Glass containers are, moreover, breakable which is a major disadvantage. Metal containers are easily deformed, irreversibly if they are dropped.

Thus, for some decades, the use of various containers in plastic materials has become commonplace for the packaging of, inter alia, liquid food products or products for use in industry or in daily life.

So there has been a progressive replacement of all sorts of containers formerly made in glass or metal by containers in plastic materials intended for the same types of use. These new containers permit easier handling and manipulation, in particular because of the reduction of the risks of breakage or of damaging deformation.

A certain number of problems specific to the use of plastic materials for packaging liquid products have appeared over time. Some of these problems are still with us, and the present invention attempts to remedy them.

For reasons of economy, it is desirable for containers in plastic materials to be as light as possible. With this in mind, and starting with forms copied from glass or metal packagings, there has been a progressive evolution of packagings in plastic materials towards forms that are better adapted to the characteristics of the material. These forms have made it possible to optimize resistance to vertical compression, the limit being given by a non-visible and non-permanent deformation of the packaging.

However, most of the forms developed which provided both good resistance to vertical compression and light weight have one major drawback: the ratio between the volume occupied by the spatial requirement of the pack and the volume of liquid product packed is high, and in no case is it close to the optimum value of 1:1. In bottles of teardrop shape, for example, this ratio is generally about 1.5:1 or 2.2:1. This represents a huge loss of volume and considerably increases the costs of packaging, handling, storage and distribution.

Due to their rigidity, most containers in plastic materials also occupy a considerable place in the volume of household or industrial wastes. It is easy to understand why this volume should be reduced as much as possible.

Moreover, packagings in parallelepipedic form have been in daily use for a very long time for packaging solid materials. Cardboard boxes, light and resistant, are particularly appreciated: they permit a good use of space, they are easy to stack and to palletize, and their volume can be reduced after use.

It is also known to use cardboard boxes for packaging liquid products, provided plastic materials have been used to make them waterproof.

In this regard are aware of boxes formed from plastified cardboard, of the brick type, that are utilized for milk, comprising a small quantity of plastic material and occupying, after use, a reduced space in refuse, provided care is taken to flatten them.

These boxes are manufactured on special machines from cardboard sheet. At least one layer of polyethylene, and possibly one layer of another material such as aluminium, are made integral with the cardboard sheet, by sticking together or by other means. This results in one particularly troublesome drawback from the ecological point of view: the materials making up the single composite layer of the packaging cannot be separated by simple means. Thus, they can neither be destroyed selectively by incineration nor recuperated for purposes of recycling. The cardboard itself, being plastified, is rendered rot-proof.

The method of opening boxes of the brick type utilized for milk is as follows: the user must lift a part, which is folded on the top of the box and folded over the sides, and cut off its corner. If the cutting operation is not performed correctly, which often occurs, milk is spilled when the user picks up the brick in order to pour out its contents. No provision is made, after opening, for the possibility of satisfactory reclosing this type of packaging.

For packaging liquid washing agents, packaging formed from a combination of cardboard and sheets of plastic materials which can, in certain cases, be reclosed each time the product is used, has recently been developed.

Particularly, packaging of the brick type for milk described above, whose method of opening is different, has been marketed; a pouring spout, consisting of an injection-moulded component made from polyethylene, is glued to the centre of the upper wall of the box. When using the container for the first time, the consumer must himself pierce a hole in the wall of the packaging, through the spout, thus creating lips which face the inside of the box. Such lips prevent total emptying of milk from the box. As the spout is applied to the outer part of the composite film forming the wall of the packaging, it can become detached due to impact or rough treatment. As with bricks for milk, any recycling of plastic material or of cardboard is impossible. Moreover, stacking and palletization are difficult due to the projecting pouring spout.

Another type of packaging known on the market and provided for liquid washing agents permits easier pouring of the product. This is packaging which consists of a cardboard sheet which has been given the form of a box, in which a sheet of plastic material welded into the form of a bag, is glued at several points. The upper wall of this packaging is manufactured with an off-centre hole. A spout which is integral with the cardboard and with the sheet of plastic material is positioned at the location of the hole provided on the top of the box.

Opening, closing and pouring of the product are relatively easy. Nevertheless, it is observed that, in practice, due in particular to the parallelepipedal form of the box, it is also virtually impossible to empty.

Once again, the composents (cardboard and plastic material) are very difficult to dissociate from one another, which is undesirable from an ecological standpoint. Moreover, this type of packaging requires the use of a considerable amount of adhesive. Finally, the problems of stacking and palletization are still not solved.

There is a particular model of this type of packaging which has a large opening provided in the cover. The spout, which is then integral only with the sheet of plastic material, is able to retract into the box via this opening. What frequently happens now is that it moves obliquely and disappears inside the box, from where it is then awkward to recover. The direction of the flow of product is not guaranteed either, on pouring.

There is also another particular model of this type of packaging, in which the spout is located in a "cut corner" of the cardboard box. In this case, the resistance of the packaging to vertical compression is diminished.

The packaging mentioned above are not designed in order to be filled via the spout. They must be manufactured and filled by complicated and expensive machines which make the cardboard, apply the plastic material thereto and proceed immediately to filling. In each case, this means that the manufacturer of the packaged product must transport his merchandise in bulk to the premises where the packaging is manufactured or invest in machines for manufacturing and filling the packaging, which involves additional cost.

SUMMARY OF THE INVENTION

The invention aims to provide packaging for liquid or pulverulent products which can be used either as a bottle or as a box.

This packaging can be manufactured by traditional machines and filled via the spout on filling lines that are traditionally used for filling bottles. In use, it will permit easy pouring of the product and good direction of the flow, as is possible with a simple bottle. In addition, during handling, transportation and storing, it can be stacked on other packs and palletized like a simple box.

It will also be possible, after use, to very easily separate the cardboard box from the empty plastic bottle, possibly with a view to recycling.

The subject of the invention is a packaging for liquid or pulverulent products, consisting of an assembly composed of a box in cardboard and a bottle in plastic material that is removably contained in that box without being attached thereto, i.e. without being glued or welded to it. In this fashion, the bottle can be very easily separated from the box without any tearing after this box has been opened. The box in question has lateral walls that terminate in respective lower extremities and a cover. An opening is made in the cover. The bottle has a base, a body, shoulders, a neck and a spout to which a stopper is fitted.

The relative dimensions of the bottle and the box are such that the bottle can be selectively vertically moved between a first retracted position in which its base is situated at the same level as the respective lower extremities of the lateral walls of the box and its spout is substantially retracted in the box, and a second extended position in which the base is situated above the level of the respective lower extremities of the lateral walls of the box, its neck being then engaged in the opening in the cover. The bottle can be displaced vertically from one position to the other and vice versa. The bottle, when contained in the box, can be filled via the spout. The stopper can be placed on and removed from the spout as desired, and the content of the bottle can be poured out via the spout. The neck of the bottle is equipped with support means which, when it is engaged in the opening, interact with the cover to ensure that the spout is maintained outside the box and the bottle is suspended in the box. These support means provide a state of temporary retention of the bottle at a height. These support means can be overcome by virtue of the temporary deformation of the cardboard of the cover when a total force, greater than that exercised by the weight of the bottle and of any product it may contain, is exercised vertically downwards on the spout.

The cardboard box might be devoid of a base (on the side opposite to the cover in which an opening is provided) but it is generally preferable for the box to have a base.

This base of the box can, however, be incomplete and formed, for example, of the edges of the lateral walls folded inwards towards the lower part of the box, the breadth of these edges being such that an opening remains in the middle of this base of the box.

According to one particular embodiment, the spout of the bottle is threaded, and the stopper is threaded in a corresponding manner. In this manner, the stopper can be positioned on and removed from the spout, so that the contents thereof may be selectively retained therein or removed therefrom.

However, this type of closing of the stopper is by no means critical, and many other systems of stoppering can be used such as, for example, systems of "bayonet" stoppering.

The body of the bottle can have a flexibility and dimensions in breadth such that it essentially corresponds to the lateral walls of the box.

The support means which can interact with the cover of the box to ensure that the spout is maintained outside the box and the suspension of the bottle in the box when the neck is engaged in (interacts with) the opening can consist of a collar which rises above the lower part of the neck.

In this way the packaging according to the invention can adopt a "box position" (the first retracted position) in which the spout is substantially retracted in the box and a "bottle position" (the second extended position) in which the spout projects from the box.

Advantageously the neck of the bottle can also be equipped, at its lower part, with locking means that interact with the cover so as to block the rotation of the neck (and thus of the bottle as a whole) when the neck is engaged in the opening of the cover. The lower part of the neck and the edges of the opening can be notched. They can also have a form that is not circular, e.g. oval, elliptical or polygonal. Hexagonal, octagonal, square or even triangular forms can be used with success.

When the spout is retracted into the box, it is advantageous for the stopper not to be entirely in the box. For this purpose, the threaded stopper will be advantageously equipped with a stop member, which can consist simply of a shoulder situated near the top of the stopper.

This part will preferably be equipped with a retention member which, when the spout is retracted inside the box, interacts with the bottom of the cover and prevents the undesired emergence of the spout from the box, caused, for example, by impacts which may occur during handling and transportation. This stop member can consist of lugs or again of a flange.

According to one embodiment, the opening made in the cover of the box has dimensions such that, when the spout is retracted inside the box, the edge of this opening grips the stopper laterally and thus prevents the undesired emergence of the spout (with its stopper) from the box.

When the spout is retracted inside the box and the user wishes to make it emerge, for example so as to pour the product, the operation will be facilitated by the presence, on the stopper, of at least one handle making it easier to pull the spout out of the box.

The body of the bottle of the packaging according to the present invention is preferably lined, over at least part of its height and at least part of its periphery, with a stiffening means, for example grooves and ribs, which can be disposed either in an axial direction or in a radial direction, or in a combination of the two.

The bottle can have a substantially circular form, or a rectangular form with rounded corners, or any other desired form. The box itself can be cylindrical or prismatic.

A material particularly suitable for the manufacture of the bottle is polyethylene, but it is also possible to use polyethylene terephtalate (PET), polypropylene or other plastic materials which can be recycled or incinerated without releasing toxic gases. The use of polyethylene is advantageous for more than one reason, since it is particularly suitable for recycling.

The bottle of the packagings according to the invention does not need to be self-supporting, its stability being assured by the box itself.

The packaging according to the invention is no heavier than a traditional bottle of the same capacity and, in certain embodiments, permits the use of three times less plastic material. When the product is poured out, it flows continuously without causing air bubbles to form in the bottle, which means that the flow can be directed with greater accuracy.

Because the external presentation of the packaging according to the invention consists of the cardboard box, it is possible to use, for the manufacture of the light bottle, plastic waste arising from the manufacture of conventional packs. In this way, a single-layer bottle can be manufactured entirely from recycled plastics. Its lightness, its consistency and its functionality will be identical with those of a bottle manufactured from fresh material. Only its appearance will be modified, for example if the recycled plastics come from wastes of silk-screen printing which involves a modification of the color of the bottle.

On the other hand, the technique of co-extrusion makes it possible today to produce multi-layer bottles, with a view to recycling plastics coming from the consumer's dustbin which may be contaminated by other products. To carry out this recycling, it is indispensable to prevent material which has been contaminated, and which no longer offers the guarantees of purity currently required for all packagings, to be separated from the content by a layer of fresh plastic material intended to avoid contact between the recycled and contaminated material and the content of the pack.

The color of the recycled material, which tends towards the most varied shades of grey, also imposes on traditional bottles an outside layer of plastic material known as a presentation layer, when the color required for the bottle is incompatible with grey.

A third layer of material, sandwiched between the first two, will permit the incorporation of wastes arising from the actual manufacture of the packagings (these wastes can represent 50% of the net weight of a bottle with a handle, for example) and the use of genuinely recycled material, i.e. contaminated and originating from refuse ("post-consumer" recycling).

The invention makes it possible to increase the share of recycled material by abolishing the presentation layer which becomes superfluous since it is the cardboard box which gives the good appearance to the packaging.

The attempt is now being made to develop packagings in degradable plastic materials. One of the difficulties encountered by these projects is to determine the lifespan of the material before the degradation starts.

In the packagings according to the invention, the bottle is protected from the light by a cardboard box until the product has been used. So it permits the use of plastic materials which degrade very rapidly under the effect of light, i.e. of UV radiation. The degradation of the plastic material begins as soon as the bottle is exposed to the light, i.e. as soon as it separated from the box, either by human action or by the natural decomposition of the cardboard.

Other features and advantages of the invention will emerge from the description given below of preferred embodiments, with reference to the appended drawings.

BRIEF DESCRIPTION OF THE DRAWINGS

FIG. 5 is a cross-section view substantially corresponding to FIG. 3, but where the inner and the outer shell of the packaging of the present invention has a substantially cylindrical form.

DESCRIPTION OF PREFERRED EMBODIMENTS

Figures 1, 2, 3, 4:
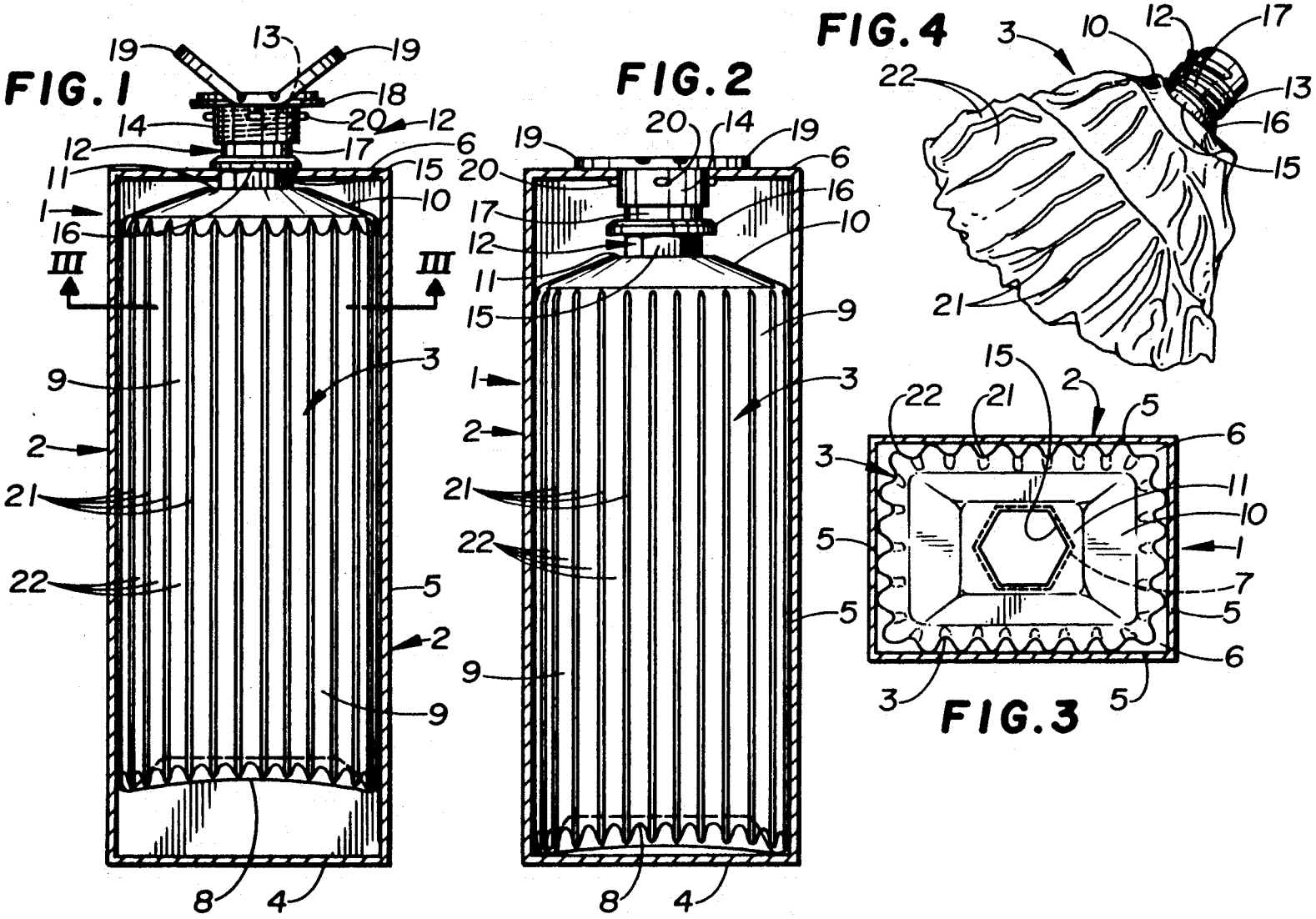
FIG. 1 is a view, partially in cross-section, of a packaging for liquid or pulverulent products according to the invention, in which the spout is in a projecting position ("bottle position").
FIG. 2 is another view, partially in cross-section, of the same packaging in which the spout is in a retracted position("box position").
FIG. 3 is a section following the line III—III of FIG. 1.
FIG. 4 is a perspective view of a bottle extracted, after use, from a packaging according to the invention, and reduced to a small volume.

FIG. 1 to 3 show a packaging for liquid or pulverulent products according to the invention.

This packaging 1 consists of a cardboard box (a substantially rigid outer shell) 2 of rectangular section and a bottle (a substantially flexible inner shell) 3. For ease of presentation, the bottle 3 is shown in elevation and the box 2 in cross-section on FIG. 1 and 2.

The box 2 has conventionally a base 4, four lateral walls 5 and a cover 6 opposite the base 4. A hexagonal opening 7 is formed in the cover 6.

The bottle 3 is made in polyethylene and is extremely light. This bottle 3 has a base 8, a body 9 extending upwardly from the base 8, the body 9 being substantially rectangular with rounded corners. Shoulders 10 extend from the upper extremity (end) of the body 9 opposite of the base 4 to a surface 11 which constitutes the limit between the shoulders 10 and the neck 12. This neck 12 extends in height from the shoulders 10 opposite of the body 9 to the start of the thread (represented by broken lines in FIG. 1) of the threaded spout 13 which extends from the neck 12 opposite of the shoulders 10 and on which a threaded stopper 14 is screwed. This stopper 14 makes it possible to open and reclose the packaging 1 as many times as desired.

As can be seen in FIG. 4, when the bottle 3 is empty, it can easily be separated from the box 2, to which it is not attached by glueing, by welding or in any other way. It can then be rolled up by hand in the same way as a toothpaste tube, which greatly reduces the volume it occupies as waste.

This feature also makes it possible to recover the product to the very last drop, avoiding waste and the mixing of product residues with refuse. The box 2 can be flattened just like any cardboard box.

It is easy to understand that the packagings according to the invention which permit total separation of the cardboard and plastic elements are of particular interest from the ecological standpoint: these components can be sorted, selectively collected and recycled.

The neck 12 is divided into three distinct elements (parts) along its height: the lower part 15, the collar 16 and the upper part 17.

It can be clearly seen on FIG. 1 and 2 that the bottle 3 can occupy, in relation to the box 2, two different positions. It can pass between the first and second positions by virtue of an effort of pressing or pulling exercised on the spout 13.

FIG. 1 shows the packaging in its "bottle position" (second extended position) in which the spout 13 has completely emerged from the box 2. In this position, the packaging 1 can be treated as a simple bottle. After removing the stopper 14, the product contained in the bottle 3 can be poured out. Because of the flexibility of the walls of the bottle 3, the product poured out flows regularly and with a good orientation.

A locking means is formed on the lower part 15 of the neck 12, so that when engaged in the opening 7 of the cover 6, it is wedged in rotation by virtue of its hexagonal form and the hexagonal form of this opening 7.

A support means is formed by the annular collar 16, which is located above the lower part 15, and which bears on the cover 6. In this manner, the spout 13 is maintained in the second extended position. In this position, the base 8 of the bottle 3 is kept at a distance from the base 4 of the box 2, which amounts to saying that the bottle 3 is suspended in the box 2 by virtue of the interaction of the collar 16 with the cover 6.

Obviously the resistance of the cardboard of which the cover 6 is constituted is sufficient to support the weight of the bottle 3, even when the latter is full of liquid or pulverulent product.

In the second extended position, the cover 6 is able to be deformed temporarily by sagging downwards under a vertical pressure exerted on the spout 13. The collar 16 then passes under the cover 6, and the bottle 3 descends progressively into the box 2 until its base 8 rests on the base 4 of the box 2 and its spout 13 is entirely retracted into this box 2, as illustrated in FIG. 2. This first retracted position is particularly advantageous for the transportation and storage of the packaging 1, which can then be conveniently stacked, by being loaded onto palettes and treated during manipulation and handling like an ordinary box.

The packaging 1 can be filled, via the spout 13, utilizing ordinary bottle filling lines.

This filling can be carried out when the spout 13 is in the second extended position (i.e. when the packaging 1 is in the "bottle" position (second extended position) as shown in FIG. 1, but obviously before the stopper 14 is put in place).

It is, however, preferable to fill the packaging 1 when it is in the "box position" (the first retracted position as shown in FIG. 2, but also, of course, before the stopper 14 is put in position). When the packaging 1 is in this first retracted position, the spout 13 is engaged in the opening 7 of the cover 6. While the spout 13 is substantially retracted into the box 2, the upper edge of the spout 13 may still extend very slightly beyond the level of this cover 6 (by about 2 mm, for example). This means that the placing of the stopper 14 (for example, after filling the packaging 1) is very easily carried out by the stoppering mechanisms of the filling lines, since the centering of the stopper 14 in relation to the spout 13 is carried out very accurately.

The stopper 14 shown in FIG. 1 and 2 is particularly suitable for the packaging In its upper part, it is equipped with a shoulder (stop member) 18 which bears on the top of the cover 6 when the spout 13 retracts in the box 2 and then acts as a stop member, thereby preventing the stopper 14 from descending entirely inside the box 2. Two handles 19 can be lifted on its upper part so as to facilitate manual pulling of the spout 13 outside the box 2, for example when it is desired to pour the product after transportation.

The stopper 14 is fitted with lugs (retention members) 20 which serve to prevent any undesired emergence of the spout 13 from the box 2 during transportation, by interacting with the bottom of the cover 6. When the spout 13 is pushed in, the lugs 20 penetrate under the cover 6 by virtue of a temporary deformation of the cover. The opening 7 of the cover 6 serves as a guide to the lower part 15 and the upper part 17 of the neck 12, even if the pressure exerted on the stopper 14 is not perfectly vertical. This characteristic combined with the existence of the shoulder 18 and handles 19 which can be folded down, ensures that the cover 6 of the box 2 has a virtually plane surface when the packaging 1 is in its "box position" illustrated in FIG. 2.

Of course, when the handles 19 of the stopper 14 are subjected to the traction necessary to bring the spout 13 out of the box 2 and to bring the collar 16 above the cover 6, the lugs 20 and the collar 16 pass through this cover 6, bending it upwards and deforming it temporarily.

FIG. 3 shows that in this preferred embodiment, the bottle 3 essentially matches the lateral walls 5 of the box 2 when liquid or pulverulent is disposed therein. Its body 9 has a corrugated form defining a stiffening means, thus forming a succession of grooves 21 and ribs 22 that are disposed in the axial (vertical) direction.

Since the walls of the bottle 3 are very thin, and particularly when the packaging 1 is filled with liquid product, a swelling of the lateral walls 5 of the box 2 may occur in the long term, mainly in the lower third of the packaging 1, where the strongest pressure is exerted. To alleviate this drawback, the body 9 of the bottle 3 presents, in the corresponding zone, a section slightly smaller than in the other parts, so as to counteract the appearance of such a swelling. Of course this characteristic is apparent only when the bottle 3 is filled.

The embodiment described with reference to the figures has many advantages which have been enumerated above. Among these advantages is its lightness of weight.

Several alternative embodiments may be provided of packagings described above without thereby departing from the scope of the invention.

Thus bottles of substantially cylindrical form can be adapted (see FIG. 5), for example, to boxes of square, hexagonal or octagonal section, and to boxes which are themselves cylindrical.

Bottles can be made with their body lined with horizontal (radial) or vertical grooves and ribs, or a combination of horizontal (radial) and vertical grooves and ribs, or bodies stiffened by virtue of diamond-shaped motifs in relief, or even smooth bottles.

The forms of the neck of the bottle and of the opening made in the cover of the box can be chosen according to requirements, regardless of the form chosen for the box and the bottle of the packaging.

I claim:

1. Packaging for liquid or pulverulent products, comprised of:

a substantially rigid outer shell, the outer shell including lateral walls, a base and a cover opposite the lower extremities, the cover having an opening formed therein;

an inner shell for removably receiving the liquid or pulverulent product therein, the inner shell including a base, a body extending upwardly from the base, shoulders extending from the body opposite of the base, a neck extending from the shoulders opposite of the body and a spout extending from the neck opposite of the shoulders;

the inner shell being movably disposed in the outer shell for vertical movement between a first retracted position, wherein the base of the inner shell rests on the base of the outer shell, and further wherein the spout is substantially retracted inside the outer shell, and a second extended position, wherein the base of the inner shell is spaced at a distance from the base of the outer shell with the spout extending outside of the outer shell, so that the inner shell is in a position in which it can be filled or emptied via the spout;

wherein the inner shell disposed in the outer shell may be filled with liquid or pulverulent product via the spout;

a stopper removably disposed on the spout, so that the stopper can be selectively positioned on and removed from the spout when desired so that the contents of the inner shell may be selectively retained therein or removed therefrom; and support means formed on the neck of the inner shell, such that when the inner shell is moved into the second extended position with the neck engaged in the opening of the cover, the support means interacts with the cover to retain the inner shell in the second extended position with the spout extending outside of the outer shell with the inner shell suspended in the outer shell;

wherein the stopper further includes a retention member that interacts with the bottom of the cover when the spout is retracted inside the outer shell, thereby preventing the undesired emergence of the spout equipped with the stopper from the inside of the shell.

2. In combination with the packaging of claim 1, the combination further comprised of:

the base of the outer shell being integral with the lateral walls opposite of the cover.

3. In combination with the packaging of claim 1, wherein the spout of the inner shell and the stopper are threaded, so as to engage one another.

4. In combination with the packaging of claim 1, wherein the inner shell is substantially flexible, so as to substantially assume the shape of the lateral walls of the outer shell when liquid or pulverulent product is disposed in the inner shell.

5. The combination of claim 4, wherein the neck further includes a lower part, and wherein the packaging is further comprised of:

the support means including an annular collar disposed above the lower part of the neck.

6. In combination with the packaging of claim 1, wherein the neck further includes a lower part and further comprising locking means formed on the lower part of the neck that interacts with the cover of the outer shell in order to lock the neck in terms of rotation when the neck is engaged in the opening.

7. In combination with the packaging of claim 1, wherein the stopper includes a stop member which bears on the top of the cover when the spout is retracted into the outer shell, thereby preventing the stopper from descending entirely inside the outer shell.

8. The combination of claim 7, wherein the stop member includes a shoulder formed near the top of the stopper.

9. In combination with the packaging of claim 1, wherein the stopper includes at least one handle for facilitating manual gripping of the stopper and pulling of the spout from the interior of the outer shell.

10. In combination with the packaging of claim 1, wherein the opening in the cover of the outer shell is sized such that when the spout is retracted inside the outer shell, the edge of this opening laterally surrounds the stopper, thereby preventing the undesired emergence of the spout equipped with the stopper from the inside of the outer shell.

11. In combination with the packaging of claim 1, the combination further comprised of:

a stiffening means over at least a part of the periphery and at least a part of the height of the inner shell.

12. The combination of claim 11, wherein the stiffening means includes the body of the inner shell having axial grooves and axial ribs formed therein.

13. The combination of claim 11, wherein the stiffening means includes the body of the inner shell having radial grooves and radial ribs formed therein.

14. In combination with the packaging of claim 1, wherein in the transverse section the body of the inner shell has a substantially circular form.

15. In combination with the packaging of claim 1, wherein in transverse section the body of the inner shell has a substantially rectangular form with rounded corners.

16. In combination with the packaging of claim 1, the outer shell has a substantially cylindrical form.

17. In combination with the packaging of claim 1, the outer shell has a substantially prismatic form.

* * * * *